United States Patent [19]

Goth

[11] 4,187,985

[45] Feb. 12, 1980

[54] AEROSOL VALVE FOR BARRIER TYPE PACKAGES

[75] Inventor: Carl W. Goth, Downers Grove, Ill.

[73] Assignee: The Continental Group, Inc., New York, N.Y.

[21] Appl. No.: 967,764

[22] Filed: Dec. 8, 1978

[51] Int. Cl.[2] ..... B05B 7/32

[52] U.S. Cl. ..... 239/337; 239/405; 239/428.5; 239/472; 239/491

[58] Field of Search ..... 239/323, 327, 328, 335, 239/337, 405, 428.5, 472, 491–493, 579

[56] References Cited

U.S. PATENT DOCUMENTS

| | | | |
|---|---|---|---|
| 1,055,715 | 3/1913 | Dahl | 239/491 X |
| 2,823,953 | 2/1958 | McGeorge | 239/323 X |
| 3,471,092 | 10/1969 | Hickey | 239/337 X |
| 3,648,932 | 3/1972 | Ewald et al. | 239/428.5 X |

FOREIGN PATENT DOCUMENTS

| | | | |
|---|---|---|---|
| 1298401 | 6/1962 | France | 239/327 |

*Primary Examiner*—Robert B. Reeves
*Assistant Examiner*—Andres Kashnikow
*Attorney, Agent, or Firm*—Charles E. Brown

[57] ABSTRACT

A dispensing nozzle for an aerosol package of the barrier type wherein a liquid product per se is directed out of the container through the usual valve. The nozzle is constructed to mix with the liquid product being dispensed air which is drawn in by the product so as to atomize the product and permit the dispensingthereof as a spray.

8 Claims, 4 Drawing Figures

AEROSOL VALVE FOR BARRIER TYPE PACKAGES

This invention relates in general to new and useful improvements in aerosol type packages, and more particularly to a dispensing valve for aerosol type packages wherein a liquid produce is dispensed.

There has recently been developed an aerosol type package wherein the liquid product to be dispensed is stored in a flexible bag separate and apart from the dispensing gas so that only a liquid is dispensed. However, with respect to certain products it is desirable that the liquid be dispensed in atomized form. Accordingly, there is now proposed a dispensing valve which is so constructed as to draw in atmospheric air and mix the same with the dispensing liquid so that an aerosol type spray is produced which has the desired spray pattern, droplet size and liquid flow rate.

Most particularly, the aerosol valve is constructed to receive a liquid being dispensed through a number of passages, with the passages opening tangentially into a spin chamber around a cone element so as to produce a low pressure at the tip of the cone element with the cone element having extending therethrough an air passage through which air is drawn for mixing with the liquid. The dispensing nozzle may also be provided with a secondary air passage which opens into the dispensing orifice for adding further air to the liquid being dispensed.

With the above and other objects in view that will hereinafter appear, the nature of the invention will be more clearly understood by reference to the following detailed description, the appended claims, and the several views illustrated in the accompanying drawings.

Figure 1:
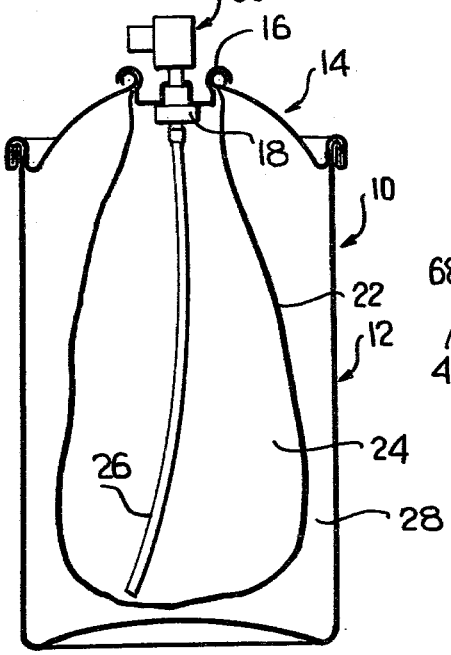
FIG. 1 is a schematic sectional view taken through an aerosol container of the barrier type having incorporated therein the spray nozzle of this invention.

Referring now to the drawings in detail, it will be seen that there is illustrated in FIG. 1 a conventional aerosol type package which is generally identified by the numeral 10 and which includes a container 12. The container 12 has a conventional upper end unit 14 in which there is seated a valve cup 16 of the conventional type which has incorporated therein a conventional valve assembly 18 of the shut-off type. The valve assembly 18 includes a dispensing tube 20 which, when depressed, opens the valve assembly 18 to effect the dispensing of a product.

The container 12 has disposed therein a product bag 22 which is sealed relative to the valve cup 16 and contains a liquid product 24. A pick-up tube 26 extends down into the bottom of the bag 22 for the dispensing of a product.

It is to be understood that the bag 22 is of a flexible and collapsible construction and the space within the container 12 surrounding the bag is a gas compartment 28 which carries a suitable gas under pressure. As a result of the continuous collapsing of the bag 22, the product therein is constantly urged under pressure into the pick-up tube 26.

The dispensing of the product from the pick-up tube 26 is prevented only by the valve 18 and when the dispensing tube is depressed the liquid product will flow out through the valve assembly and the dispensing tube in a continuous stream.

The aerosol package 10 thus described is conventional and not in or of itself part of this invention.

This invention particularly relates to a dispensing nozzle, generally identified by the numeral 30, which is carried by the dispensing tube 20 and serves both for the directing of a spray of the product being dispensed and for the actuation of the dispensing tube 20.

Basically, the nozzle 30 includes a housing 32 having a vertical bore 34 opening out through the bottom thereof with the bore 34 being of a size snugly to receive the dispensing tube 20 in sealed relation.

The housing 32 is further provided with a transverse bore 36 which opens through a side wall of the housing 32 and generally intersects the bore 34. An inner part of the bore 36 is surrounded by an annular groove or passage 38 into which the bore 34 opens.

The bore 36 may have a counterbore 40 at the open end thereof. The housing 32 may have a further bore 42 coaxial with the bore 36 and opening thereinto at the opposite end from the counterbore 40. The bore 42 defines an air passage.

The nozzle 30 further includes a pair of assembled nozzle elements which are mounted within the bore 36 and the counterbore 40. These nozzle elements include a supply tube, generally identified by the numeral 44, and a cap, generally identified by the numeral 46.

The supply tube 44 is in the form of a generally cylindrical member 48 which has formed at one end thereof a spin chamber 50 which surrounds the base portion of an upstanding conical element 52. The member 48 has extending axially therethrough a small diameter air passage 54 which opens through the apex of the conical element 52.

The exterior surface of the member 48 has formed therein a plurality of product passages 56 which are generally rectangular in cross section and which have axial central planes which are disposed tangential to the base of the conical element 52. Thus, while the product passages 56 open into the spin chamber axially, they also open into the spin chamber in a generally radial direction tangential to the conical element.

The cap 46 is also in the form of a generally cylindrical member 58 which has a bore 60 in the lower end thereof of a size snugly to receive the supply tube 44. The bore 60 terminates in a shoulder 62 against which the end of the supply tube 44 abuts.

It is also to be seen that the cap 58 has opening into the bore 60 the base of a conical recess 64 which has its walls parallel to the walls of the conical element 52. The conical element 52 extends into the recess 64 and together with the cap 46 defines a generally conical spin chamber 66 which terminates at the small end thereof in an axially located discharge passage 68 which is in alignment with the air passage 54.

Figure 4:
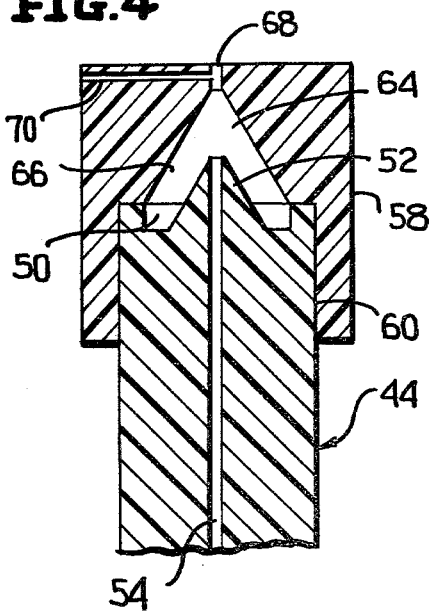
FIG. 4 is a vertical sectional view taken through the assembled cap and supply tube.

With particular reference to FIG. 4, it is to be understood that a liquid product being dispensed will pass through the spin chamber 50 through the passages 56 and then spin about the conical element 52 as it passes toward the discharge orifice 68. The spinning liquid will result in the production of a law pressure zone at the end of the air passage 54 so as to draw atmospheric air into the conical spin chamber 66. This air will mix with the liquid and cause atomization of the same so that it is discharged into the discharge orifice 68 in the form of a spray.

In order to facilitate further atomization of the liquid passing out through the discharge orifice 68, a further air passage 70 extends from the exterior of the cap 46 into the discharge orifice 68. As the product spray passes through the discharge orifice 68, further air is drawn into the nozzle through the air passage 70 and mixes with the liquid supply further to atomize the liquid.

It is to be understood that by properly proportioning the various passages and chambers, the desired product spray can be obtained. Accordingly, when the aerosol package 10 is provided with the discharge nozzle 30, an atomized liquid-air spray is directed out through the discharge orifice 68.

Figure 2:
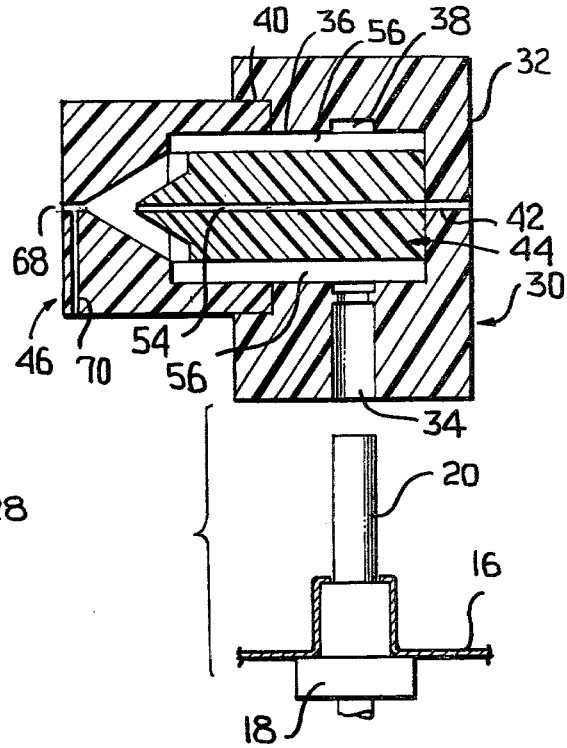
FIG. 2 is an enlarged exploded sectional view taken through the dispensing nozzle and an associated dispensing tube.
Figure 3:
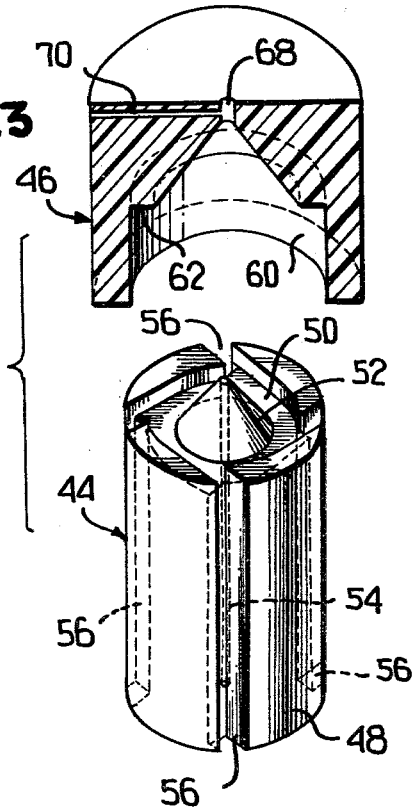
FIG. 3 is an enlarged exploded view showing the components of the dispensing nozzle including a spray tube shown in perspective and a cap shown partially in section.

Referring once again to FIG. 2, it will be seen that the assembled supply tube 44 and cap 46 are properly seated within the housing 32 with the air passage 54 aligned with and in communication with the air passage 42. Further, the liquid passages 56 are in communication with the annular supply passage 38 for receiving liquid therefrom. The discharge orifice 68 is properly positioned for directing spray of the product in the desired direction.

It is to be understood that when the housing 32 is depressed, the liquid being dispensed will be supplied thereto through the dispensing tube 20 and that the liquid will pass into the annular chamber 38 and then into the liquid passages 56.

Although only a preferred embodiment of the nozzle has been specifically illustrated and described herein, it is to be understood that minor variations may be made therein without departing from the spirit and scope of the invention as defined by the appended claims.

I claim:

1. A discharge nozzle assembly for use in conjunction with a pressurized liquid product supply, said nozzle assembly comprising a supply tube and a cap, said supply tube and said cap being separately formed, said supply tube comprising a circular cross-sectional elongated member having recessed in one end thereof a spin chamber, said cap being telescoped over said supply tube one end and in conjunction therwith forming a conical extension of said spin chamber, a discharge orifice opening from said spin chamber extension through said cap, said elongated member having formed in the outer surface thereof axial liquid passages of a depth to enter into said spin chamber and a central air inlet passage opening from the atmosphere into said spin chamber extension in alignment with said discharge orifice, said spin chamber and said spin chamber extension in conjunction with pressurized liquid flowing through said liquid passages forming suction means for drawing air into said spin chamber extension for mixing with the liquid, said spin chamber conical extension being in part formed by a cone element projecting axially from the center of said spin chamber.

2. The discharge nozzle of claim 1 wherein said cone element has an apex and said air passage opens through said apex.

3. The discharge nozzle of claim 1 wherein said cone element has a base, and each of said liquid passages being generally centered on a plane disposed tangential to said cone element.

4. The discharge nozzle of claim 1 wherein said spin chamber conical extension is in part formed by a conical recess formed in said cap.

5. The discharge nozzle of claim 1 wherein there is a supplemental air passage extending through said cap directly into said discharge orifice.

6. The discharge nozzle of claim 1 wherein said supply tube and cap are carried by a valve actuator.

7. The discharge nozzle assembly of claim 6 wherein said valve actuator has a bore receiving said supply tube and a counterbore receiving said cap, said valve actuator further having a liquid product delivery passage in communication with all of said axial liquid supply passages.

8. The discharge nozzle assembly of claim 1 wherein said axial liquid supply passages extend the full length of said elongated member.

* * * * *